US006431372B1

(12) United States Patent
Aoyama

(10) Patent No.: US 6,431,372 B1
(45) **Date of Patent: *Aug. 13, 2002**

(54) SUPPORT UNIT AND ASSEMBLIED RACK FOR LOADING LONG OBJECTS

(75) Inventor: Kunitoshi Aoyama, Komaki (JP)

(73) Assignee: NGK Insulators, Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/104,379

(22) Filed: Jun. 25, 1998

(30) Foreign Application Priority Data

Jun. 27, 1997 (JP) ..... 9-171513

(51) Int. Cl.[7] ..... A47F 7/00
(52) U.S. Cl. ..... 211/59.4; 211/60.1; 206/446
(58) Field of Search ..... 211/59.4, 60.1, 211/70.4, 194, 117; 206/446, 443

(56) References Cited

U.S. PATENT DOCUMENTS

| | | | | | |
|---|---|---|---|---|---|
| 844,915 | A | * | 2/1907 | Bool et al. | 211/60.1 |
| 2,539,809 | A | * | 1/1951 | Buckley | 211/59.4 |
| 2,593,472 | A | * | 4/1952 | McGinn | 211/59.4 |
| 2,801,752 | A | * | 8/1957 | Jakubowski | 211/60.1 X |
| 2,990,951 | A | * | 7/1961 | Fallert | 206/597 |
| 3,091,348 | A | * | 5/1963 | Neuhauser | 206/391 |
| 3,135,227 | A | * | 6/1964 | Yerkey et al. | 108/53 |
| 3,322,286 | A | * | 5/1967 | Sylvester | 211/194 |
| 3,489,274 | A | * | 1/1970 | Hughes et al. | 206/65 |
| 3,502,227 | A | * | 3/1970 | Konstant et al. | 211/177 |
| 3,537,599 | A | * | 11/1970 | Jay | 211/60.1 X |
| 3,559,812 | A | * | 2/1971 | Wolf | 211/60 |
| 3,581,907 | A | * | 6/1971 | Schmidt | 211/177 |
| 3,590,752 | A | * | 7/1971 | De Pew | 211/60.1 X |
| 3,838,679 | A | * | 10/1974 | Welch | 211/60.1 X |
| 3,857,494 | A | * | 12/1974 | Giardini | 211/194 X |
| 4,199,070 | A | * | 4/1980 | Magnussen, Jr. | 211/60.1 |
| 4,360,001 | A | * | 11/1982 | Thompson | 211/60.1 X |
| 4,469,341 | A | * | 9/1984 | Creim | 211/60.1 X |
| 4,509,650 | A | * | 4/1985 | Wilgosz | 211/60.1 |
| 4,610,362 | A | * | 9/1986 | Remp et al. | 211/59.4 |
| 4,616,757 | A | * | 10/1986 | Hobson | 211/189 |
| 4,630,739 | A | * | 12/1986 | Levenberg | 211/194 X |
| 4,673,092 | A | * | 6/1987 | Lamson et al. | 211/194 X |
| 4,706,822 | A | * | 11/1987 | Remp, Jr. et al. | 211/59.4 |
| 4,747,495 | A | * | 5/1988 | Hoss | 211/194 X |
| 4,801,024 | A | * | 1/1989 | Flum et al. | 211/59.4 |
| 5,060,810 | A | * | 10/1991 | Jones | 211/59.4 |
| 5,080,314 | A | * | 1/1992 | Moyer et al. | 211/59.4 X |
| 5,123,547 | A | * | 6/1992 | Koch | 211/59.4 |
| 5,161,703 | A | * | 11/1992 | Patton | 211/294 |
| 5,318,150 | A | * | 6/1994 | Donaho | 211/194 X |
| 5,348,149 | A | * | 9/1994 | McCarthy | 211/194 X |
| 5,433,322 | A | * | 7/1995 | Williams | 206/443 |
| 5,577,619 | A | * | 11/1996 | Callahan | 211/60.1 X |
| 5,649,632 | A | * | 7/1997 | Terashima et al. | 211/59.4 |
| 5,673,801 | A | * | 10/1997 | Markson | 211/59.3 |
| 5,743,413 | A | * | 4/1998 | Noll | 211/60.1 |

* cited by examiner

*Primary Examiner*—Daniel P. Stodola
*Assistant Examiner*—Khoa Tran
(74) *Attorney, Agent, or Firm*—Parkhurst & Wendel, L.L.P.

(57) ABSTRACT

A support unit and assembled rack in which long objects can be stacked easily, and products with a different length can be accommodated, light weight can be achieved, storage space is not needed, and waste generated in disassembly can be reduced. The support unit has a shelf portion on which long objects are placed and a fitting portion for connecting the upper portion and the lower portion of the support units to each other to assemble racks of the support units. At least the vicinities of both end portions in the lengthwise direction of a plate-shaped member are held by connecting members. One end of the connecting member protrudes upwardly to the lengthwise direction of the plate-shaped member to form a concave portion, and the plate-shaped member protrudes from the other end of the connecting member to form a convex portion, by which a fitting portion is formed. An assembled rack of plural pairs of support units are spaced on a pallet so that shelf portions for placing long objects are opposed to each other.

9 Claims, 10 Drawing Sheets

SUPPORT UNIT AND ASSEMBLIED RACK FOR LOADING LONG OBJECTS

BACKGROUND OF THE INVENTION AND RELATED ART STATEMENT

The present invention relates to a support unit and an assembled rack for loading long objects such as polymer insulators and a method of loading long objects using the same.

Generally, the handling such as storage and transportation of long objects is difficult to perform.

Here, explanation is given by taking the transportation of long objects such as polymer insulators as an example. Usually, since long objects are scarcely transported one by one, many long objects are bundled or stacked in a box and then transported. Conventionally, a method has been used in which, as shown in FIG. 2, long objects 21 packaged independently by using a polyethylene bag are put into a box 22 and stacked, the box 22 is sealed by a cover, and then transportation is provided. Alternatively, a method has been used in which, as shown in FIG. 3, at least two pairs of rails 24 and 25 are provided near both end portions in the lengthwise direction in a box 22, support plates 26 are inserted between the rails 24 and 25, and then long objects 27 are stacked by repeating the operation of arranging the long objects 27 in parallel on the support plate 26.

However, the conventional methods present a problem of requiring troublesome work. Specifically, the method shown in FIG. 2 requires individual packaging, and the method shown in FIG. 3 requires the installation of rails in the box and the fabrication of many support plates.

Also, these methods pose the following various problems because they use a box: it is difficult to perform work for stacking long objects in a box having a depth, boxes of various sizes must be prepared to accommodate products of various lengths, a large storage space is needed even if the box is empty, the total weight including a box is heavy, a large amount of waste is produced when the box is disassembled after transportation, and so on. These problems remarkably increase the transportation cost for long objects.

SUMMARY OF THE INVENTION

The present invention was made to solve the problems with the prior art, and accordingly an object thereof is to provide a support unit and assembled rack for loading long objects and a method of loading long objects using the same, in which long objects can be stacked easily, products with a different length can be accommodated, lightweight can be achieved, a storage space is not needed, and the waste generated in disassembly can be reduced.

The present invention provides a support unit for supporting ends of long objects, comprising a shelf portion at which long objects are placed and a fitting portion for connecting the upper portion and the lower portion of said support units to each other to assemble said support units.

Preferably, the support unit is configured by one flat plate shaped member and plural pairs of connecting members, at least the vicinities of both end portions in the lengthwise direction of the flat plate shaped member are held in the thickness direction of the flat plate shaped member by a pair of connecting members, and one end of each of the paired connecting members is disposed so as to protrude perpendicularly to the lengthwise direction of flat plate shaped member to form a concave portion between the connecting members, and the flat plate shaped member is protruded from the other end of each of the paired connecting members to form a convex portion between the connecting members, by which a fitting portion is formed.

Also preferably, the support unit is configured by a plurality of connecting members and a pair of flat plate shaped members, at least in the vicinities of both end portions in the lengthwise direction of the paired flat plate shaped members, one connecting member is held in the thickness direction of the connecting member by the paired flat plate shaped members, and one end of each of the connecting members is disposed so as to protrude perpendicularly to the lengthwise direction of the paired flat plate shaped members to form a convex portion between the flat plate shaped members, and the paired flat plate shaped members are protruded from the other end of each of the connecting members to form a concave portion between the flat plate shaped members, by which a fitting portion is formed.

Further preferably, notches or protrusions are provided at a portion forming a shelf portion of flat plate shaped member in the support unit to prevent a long object from rolling.

Also, the present invention provides an assembled rack comprising the aforesaid support units and a pallet, wherein the rack is assembled opposedly on the top surface of the pallet so that shelf portions of the plural pairs of support units for placing long objects are opposed to each other.

The assembled rack is preferably used when the long object is a polymer insulator.

Further, the present invention provides a method of loading long objects, comprising a method of loading long objects, comprising the steps of: a first step of mounting a pair of support units comprising a shelf portion at which long objects are placed and a fitting portion for connecting the upper portion and the lower portion of said support units to each other to assemble said support units on the top surface of a pallet so that shelf portions for placing long objects are opposed to each other; a second step of placing long objects between said opposed shelf portions; a third step of stacking another pair of support units on top of said support units via fitting portions: and a fourth step of constructing a assembled rack defined in claim 5 by repeating the second and third steps arbitrary times, and then fastening said pallet and said assembled rack to each other.

The method of loading long objects is preferably used when the long object is a polymer insulator.

DETAILED DESCRIPTION OF THE PREFERRED EMBODIMENT

The present invention uses a loading method in which an assembled rack is formed on a pallet by vertically connecting support units.

Thus, products of various lengths can be accommodated by using one type of standardized support unit, and boxes different according to product need not be prepared.

Also, long objects can be stacked easily, lightweight and saved storage space can be achieved, and the amount of waste can be reduced in disassembling as compared with the case where a box is used.

The following is a detailed description of the present invention.

The support unit of the present invention is a member for placing and supporting long objects. A shelf portion for placing long objects and the upper and lower portions of the support unit are connected to each other, and the support unit has fitting portions for assembling.

For the support unit, a pair of support units are used as a set and can support long objects by placing both ends in the lengthwise direction of long object on the shelf portion of the respective support units.

As a material for the support unit, wood, which is inexpensive, easy to work, and easy to scrap, can be used preferably.

The shape of the support unit is not subject to any special restriction as long as the shelf portion for placing long objects and the upper and lower portions of the support unit are connected to each other, and the support unit has fitting portions for assembling, but, for example, the construction as described below can be employed.

Figure 1:
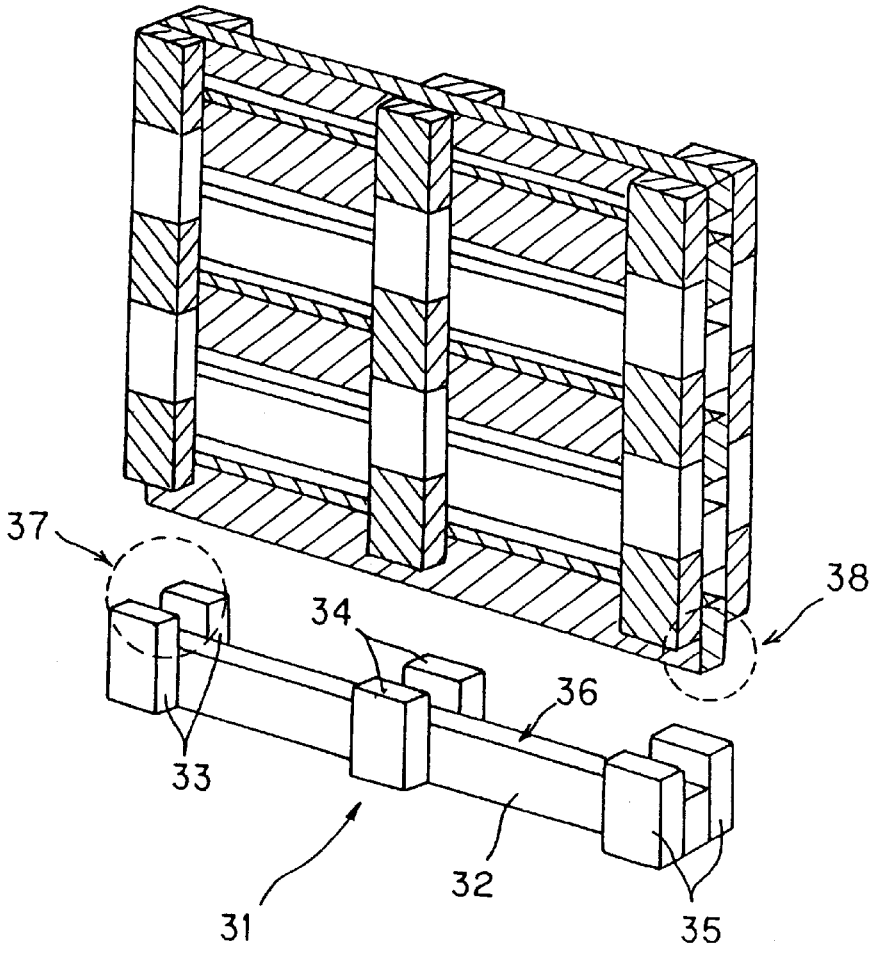
FIG. 1 is a schematic perspective view showing one embodiment of a support unit in accordance with the present invention.
Figure 2:
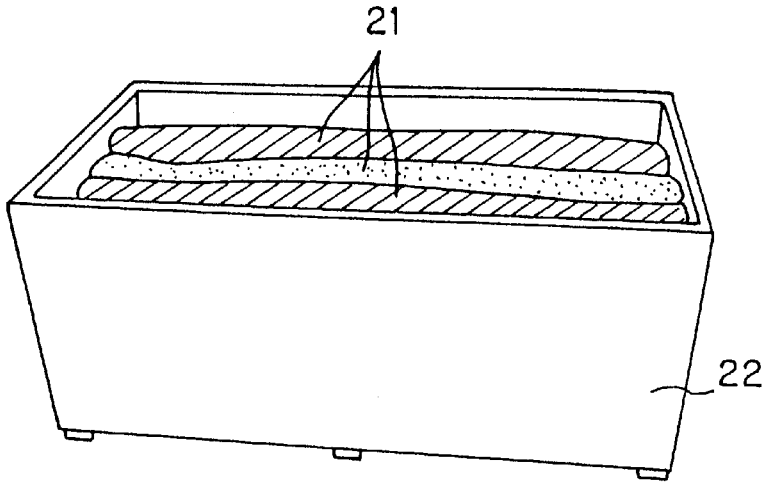
Fig.2 Prior Art
FIG. 2 is a schematic view showing a conventional example of storing method for long objects.
Figure 3:
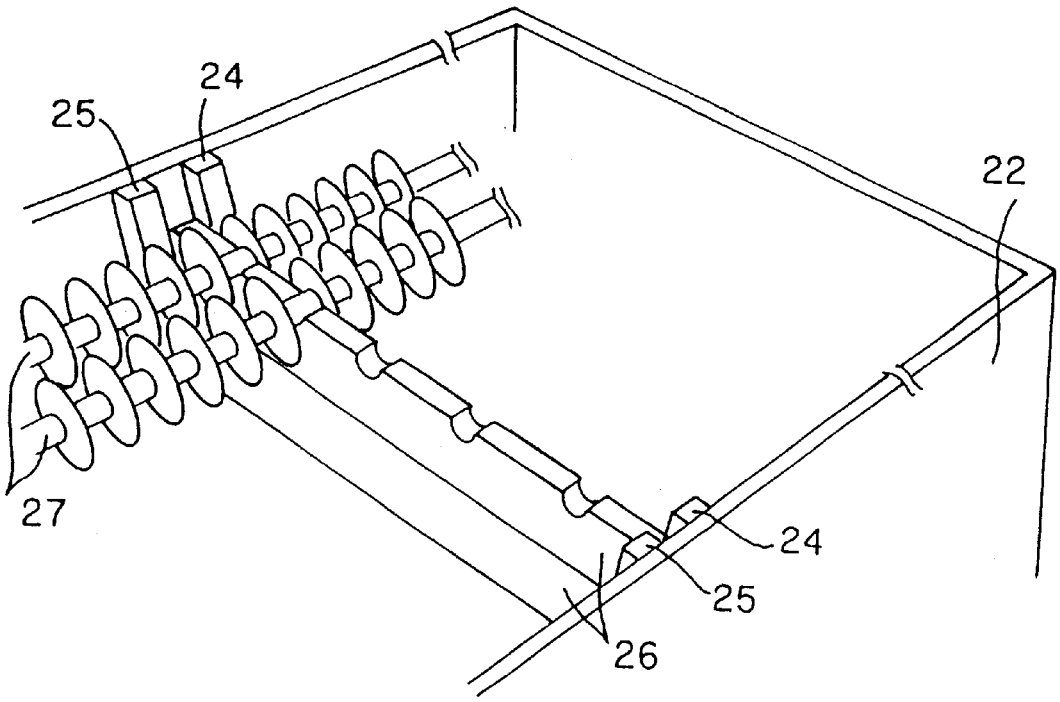
Fig.3 Prior Art
FIG. 3 is a schematic view showing another conventional example of storing method for long objects.

FIG. 1 shows an example in which a support unit 31 is made up of one flat plate shaped member 32 and plural pairs of connecting members 33, 34, and 35. In the example shown in FIG. 1, the upper end face of the flat plate shaped member 32 forms a shelf portion 36 for placing one end of a long object, and portions where the flat plate shaped member is held by three pairs of connecting members form the fitting portions for connecting the support units to each other.

Such a configuration is preferable in terms of lightweight as compared with the later-described support unit shown in FIG. 4.

The following is a more detailed description of the fitting portion.

The fitting portion must have a construction such that at least both end portions of one flat plate shaped member 32 are held by the paired connecting members 33 and 35 in the thickness direction of the flat plate shaped member 32, but it is preferable that connecting members 34 be also provided at the center as shown in the figure to prevent deflection and breakage of the central portion of the flat plate shaped member caused by a load. Further, other connecting members may be disposed at other portions as long as a space for placing long objects can be secured.

Each of the paired connecting members 33, 34, and 35 is disposed so that one end protrudes so as to intersect at right angles to the lengthwise direction of the flat plate shaped member 32 so that a concave portion 37 is formed between the connecting members, and a convex portion 38 is formed by protruding the flat plate shaped member 32 from the other end.

By fitting the convex portion 38 into the concave portion 37, a plurality of support units can be connected vertically and stacked.

Figure 5:
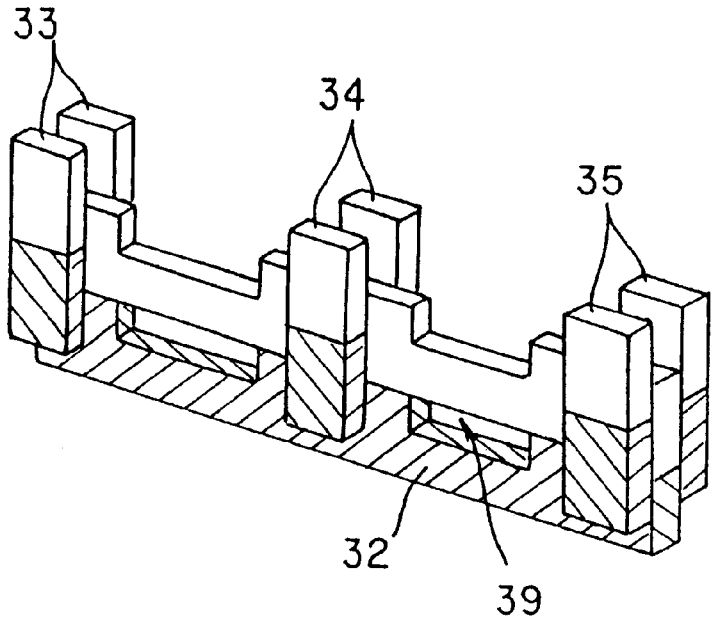
FIG. 5 is a schematic perspective view showing an example of a support unit formed with openings.

The length of the convex portion 38 and the depth of the concave portion 37 are not subject to any special restriction as long as the support units can be connected surely, but it is preferable that a space for inserting long objects be secured by making the length of the convex portion 38 is greater than the depth of the concave portion 37 by a dimension larger than the outside diameter of long object. When the configuration is not as described above, the space can be secured by providing openings 39 in the flat plate shaped member 32 as shown in FIG. 5.

Although in the example shown in FIG. 1, the concave portion 37 is formed on the upper end side of the support unit 31, and the convex portion 38 on the lower end side, a vertically inverted configuration can achieve the same effect.

Also, for the support units used at the uppermost and lowermost ends when a plurality of support units are stacked, the fitting portion at the end to which another support unit is not connected can be omitted as shown in FIG. 1.

Figure 4:
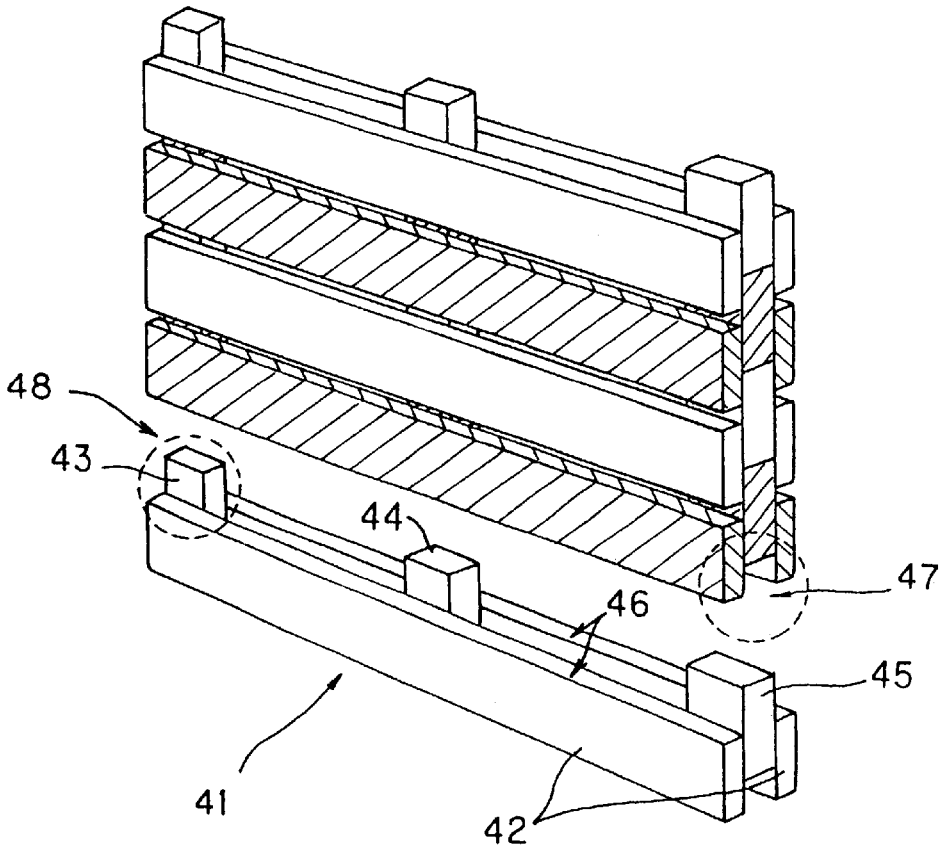
FIG. 4 is a schematic perspective view showing another embodiment of a support unit in accordance with the present invention.

FIG. 4 shows an example in which a support unit 41 is made up of a plurality of connecting members 43, 44, and 45 and a pair of flat plate shaped members 42. Like the support unit shown in FIG. 1, the upper end face of the flat plate shaped member 42 forms a shelf portion 46 for placing one end of a long object, but portions where three connecting members 43, 44, and 45 are held by the paired flat plate shaped members 42 form fitting portions for connecting the support units to each other.

Such a configuration is preferable in terms of strength as compared with the above-described support unit shown in FIG. 1.

In this case, the fitting portion must have a construction such that each one of the connecting members 43 and 45 is held in the thickness direction at least in the vicinities of both end portions in the lengthwise direction of the flat plate shaped member 42, but it is preferable that connecting member 44 be also provided at the center for the same reason as in the case shown in FIG. 1. Further, other connecting members may be disposed at other portions.

Each of the connecting members 43, 44, and 45 is disposed so that one end protrudes so as to intersect at right angles to the lengthwise direction of the flat plate shaped member 42 so that a convex portion 48 is formed, and a concave portion 47 is formed between the flat plate shaped members 42 by protruding the flat plate shaped members 42 from the other end.

By fitting the convex portion 48 into the concave portion 47, a plurality of support units can be connected vertically and stacked.

Also, for the same reason as that of the support unit shown in FIG. 1, it is preferable that the length of the convex portion 48 is made greater than the depth of the concave portion 47 by a dimension larger than the outside diameter of long object, and the support unit 41 shown in the figure may be configured by being inverted vertically.

Also, for the support units used at the uppermost and lowermost ends when a plurality of support units are stacked, the fitting portion at one end to which another support unit is not connected can be omitted.

Figure 6:
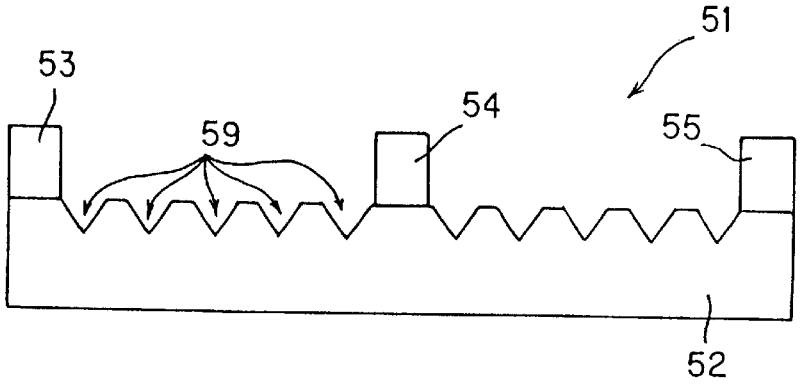
FIGS. 6(*a*) and 6(*b*) are schematic views showing examples of support units provided with notches and protrusions, respectively.
Figure 6:
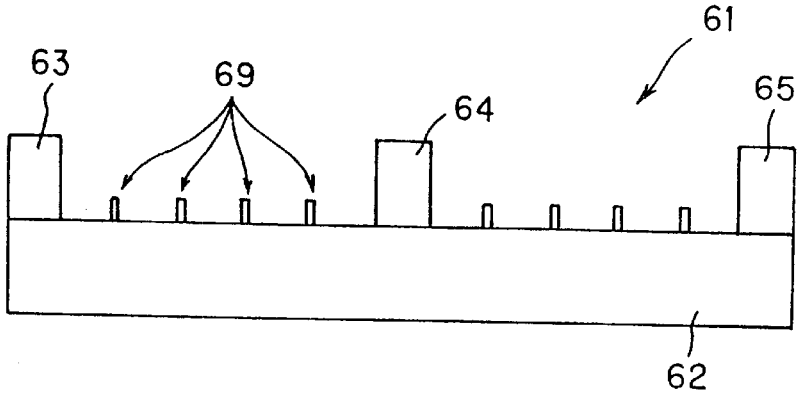

Further, it is preferable that notches 59 or protrusions 69 be provided at the portion forming the shelf portion of the flat plate shaped member 52, 62 of the support unit 51, 61 as shown in FIGS. 6(*a*) and 6(*b*).

These configurations are preferable because the rolling of the long objects placed in parallel can be prevented, by which the damage to the long object can be avoided.

Figure 7:
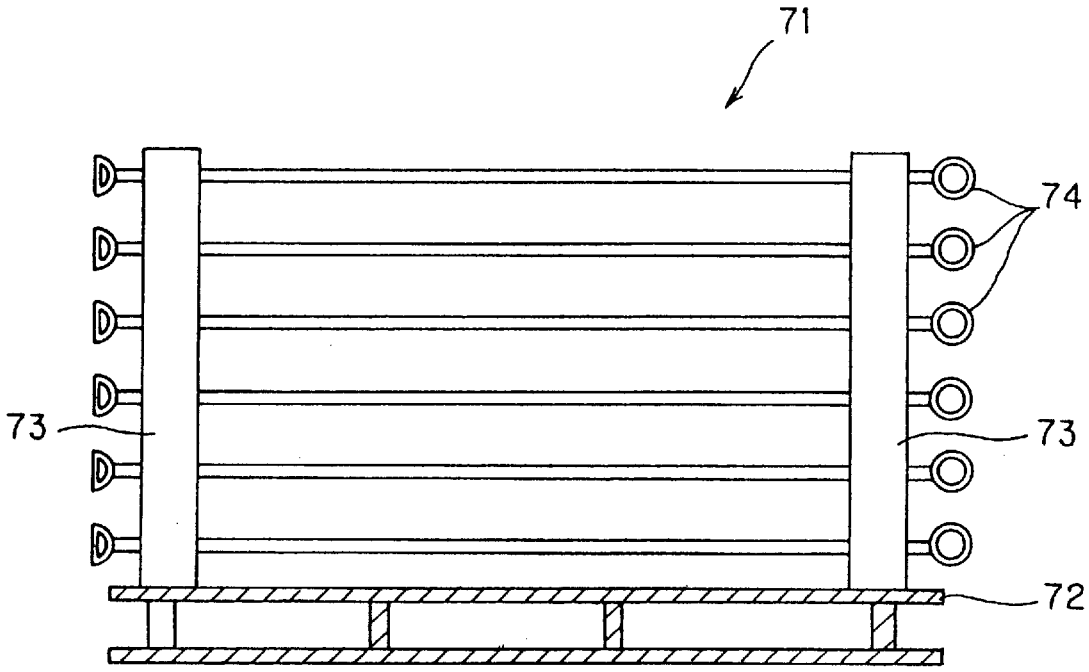
FIG. 7 is a schematic view showing one embodiment of an assembled rack in accordance with the present invention.

As shown in FIG. 7, an assembled rack 71 in the present invention, which comprises the aforementioned plural pairs of support units and a pallet 72, is configured so that the shelf portions of the plural pairs of support units for placing long objects 74 are opposed to each other, and support unit groups 73 are assembled on the top surface of the pallet 72 so as to oppose to each other.

Thus, by adjusting the distance between the support units mounted on the pallet or by appropriately selecting the length of the pallet, long objects of various lengths can be stacked at a high density.

Since this rack is of an assembly type, when it is not in use, the pallet and the support units can be disassembled for storage, so that a storage space is not needed unlike an empty box. Also, since the assembled rack has a smaller number of components than the box, the waste is less when it is scrapped.

Further, since the long object and the support unit are stacked alternately, the stacking work is easy to perform as compared with the case where long objects are stacked in a deep box.

The pallet 72 is a portable platform for storing and transporting cargoes as shown in FIG. 7, and usually made of wood. In the present invention, an assembled rack is formed by mounting and stacking the support units on the top surface of the pallet 72.

When the long object is 1.8 m or longer, the central portion of the long object tends to deflect depending on the material of long object placed transversely.

Therefore, it is preferable that a support member be inserted in a gap of the long objects placed in parallel between one support unit group and the other support unit group.

The material of the support member should be selected appropriately depending on the material of the long object, but it is preferable that the material of the support member have a compressive strength capable of withstanding the load of long object and a hardness of a degree such that the surface of long object is not damaged. For example, for the long object such as polymer insulator whose outer periphery is made of silicone rubber, the support member can also be made of a soft material. Specifically, polyethylene foamed to 15 to 25 times and the like can be used preferably.

The above is a description of a case where long objects are stored by using the assembled rack. When the long objects are transported by using this assembled rack, it is preferable that cover materials 82 be put on the top surface of an assembled rack 81 as shown in FIG. 8 to reinforce the assembled rack.

By this reinforcement, the assembled rack 81 can be transported by being stacked further, so that the transportation efficiency can be increased.

Figure 8:
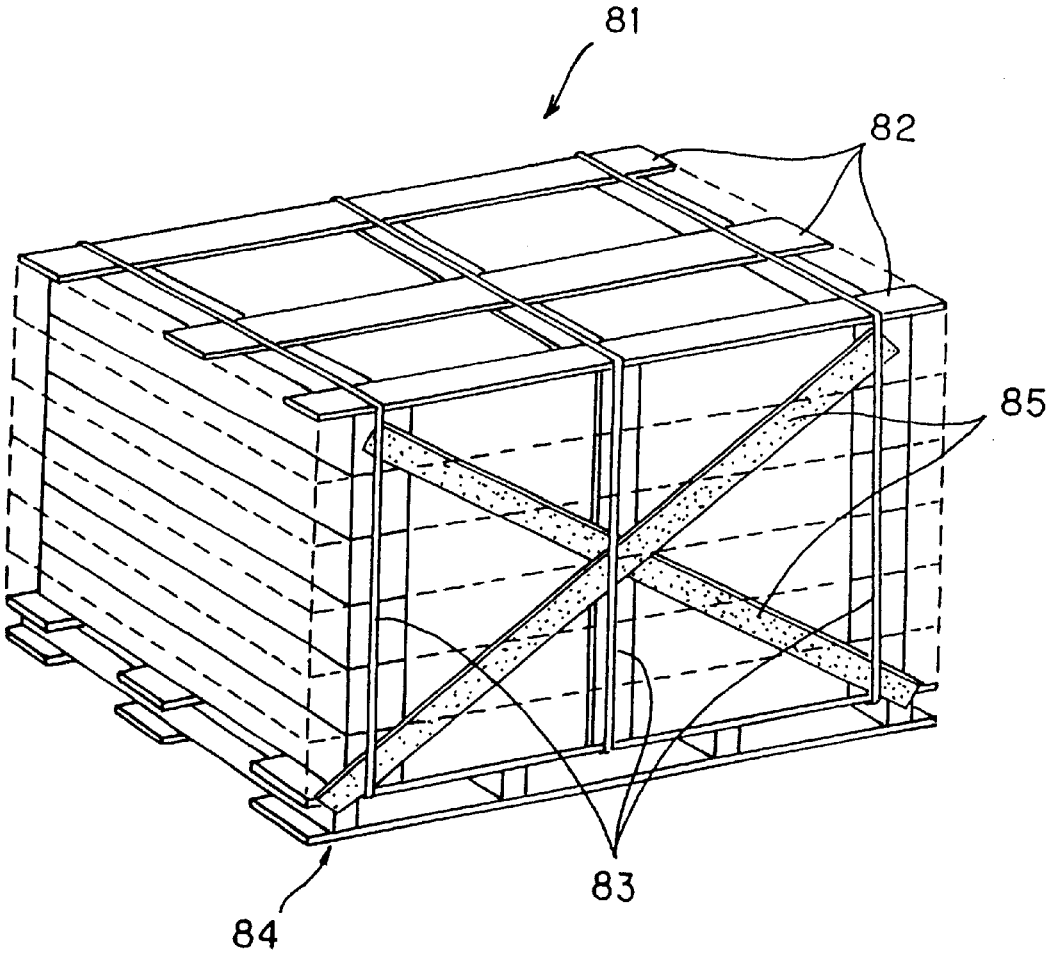
FIG. 8 is a schematic perspective view showing one embodiment of a loading method for long objects in accordance with the present invention.

Also, as shown in FIG. 8, it is preferable that the assembled rack 81 and a pallet 84 are bound with bands 83 made of, for example, band steel, rubber, cloth, or plastics, or a plastic film to prevent the load from falling. Alternatively, it is preferable that the side of the assembled rack 81 and the pallet 84 be fixed by installing reinforcing members. From the viewpoint of secure fixing, the installation of reinforcing members is preferable as compared with the binding with bands.

For the reinforcing member, it is preferable to install a brace on a diagonal line on the side surface of the assembled rack 81. It is better that two braces 85 be installed as shown in FIG. 8 because firm fixing can be provided.

The method of joining the reinforcing member to the assembled rack should be selected appropriately according to the materials of the reinforcing member and assembled rack. When all are made of wood, the joining can be performed by using nails or screws.

EXAMPLES

The support unit and assembled rack and the method of loading long objects using the same in accordance with the present invention will be described below by taking an example in which a polymer insulator is used as the long object. However, the present invention is not limited to the Embodiments shown in the figures.

Figure 9:
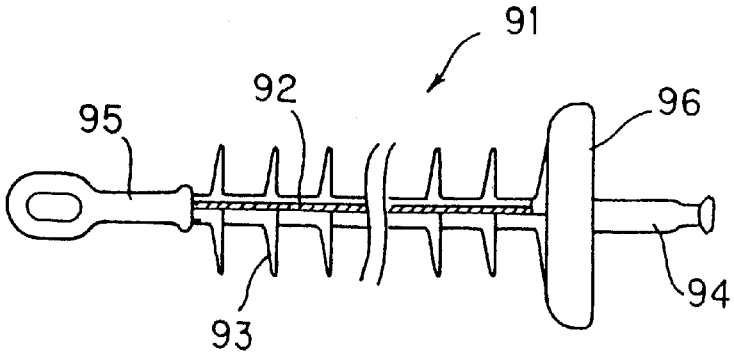
FIG. 9 is a schematic view of a polymer insulator.

A polymer insulator 91 shown in FIG. 9, which is a high-voltage outdoor insulator made of an organic insulating material, is a long object made up of a shank 92, consisting of an FRP core, for supporting a mechanical load, umbrella portions 93, made of silicone rubber, for protecting the shank, holding metal fittings 94 and 95, and a corona shield ring 96, if necessary.

(Embodiment 1)

Figure 10:
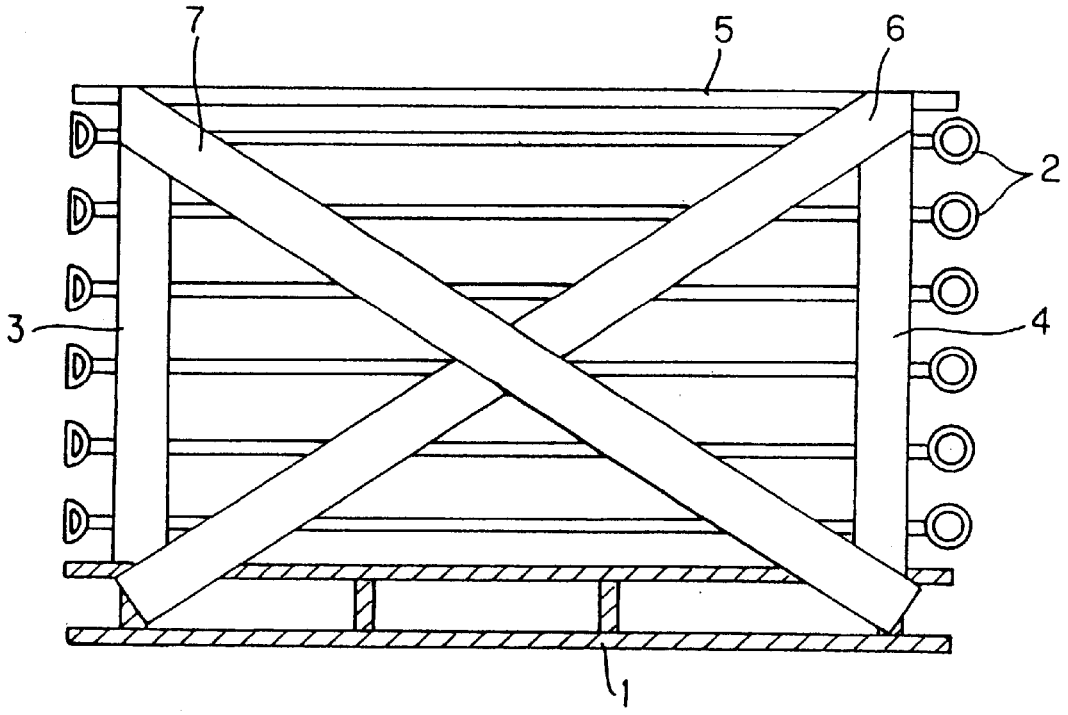
FIG. 10 is a schematic view showing an Embodiment of a loading method for long objects in accordance with the present invention.

FIG. 10 shows an example in which the present invention is applied to relatively short polymer insulators.

In this Embodiment, a polymer insulator with a total length of about 1700 mm, a shank diameter of 26 mm, and an umbrella diameter of 126 mm was used.

For the support unit, the connecting member formed a convex portion on the upper end side, and the flat plate shaped member formed a concave portion on the lower end side, the convex portion having a length of 90 mm, and the concave portion having a depth of 400 mm, and a total of three connecting members were disposed at both end portions of the flat plate shaped member and at the center thereof.

The support units, reinforcing members, and braces were all made of wood.

First, a pair of support units are set so as to match the length of a polymer insulator 2 to be loaded on a pallet 1, and twelve polymer insulators 2 are mounted in parallel between the shelf portions of the support units so that the holding metal fitting comes into contact with the upper end face of flat plate shaped member, that is, the shelf portion.

Next, the support units are connected and stacked by fitting the convex portion at the upper end of the support unit into the concave portion of another support unit, and polymer insulators 2 are mounted in parallel likewise between the shelf portions of other support units.

After support unit groups 3 and 4 are formed by repeating the above operation eight times, cover materials 5 are put on the top end faces of the uppermost support units, by which the opposed support unit groups 3 and 4 are fastened in order not to be separated from each other. At both sides of the support unit groups 3 and 4, two braces 6 and 7 are installed on diagonal lines so as to intersect, by which the pallet 1 and the support unit groups 3 and 4 are fastened in order not to be separated from each other.

(Embodiment 2)

Figure 11:
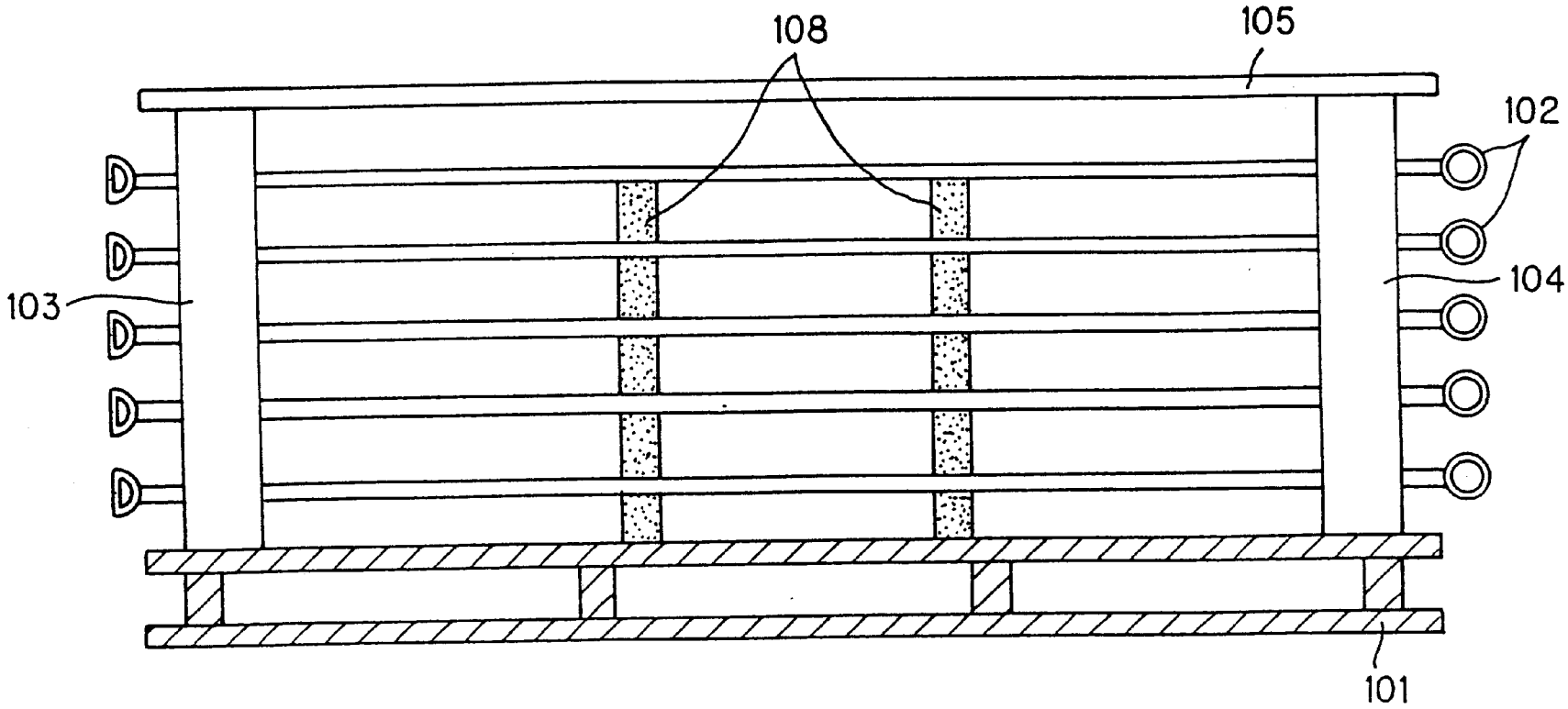
FIG. 11 is a schematic view showing another Embodiment of a loading method for long objects in accordance with the present invention.

FIG. 11 shows an example in which the present invention is applied to relatively long polymer insulators. Considering a large deflection of long object, support members for preventing deflection are inserted between the layers.

In FIG. 11, braces are omitted for explanation.

In this Embodiment, a polymer insulator 102 with a total length of about 2700 mm, a shank diameter of 26 mm, and an umbrella diameter of 126 mm was used.

Also, a support unit used was the same as that used in Embodiment 1, and a cover material 105 and a brace, not shown, used were the same as those used in Embodiment 1 except the length thereof.

Further, in this Embodiment, as a support member 108, polyethylene foamed to 15 times having a shape similar to that of the flat plate shaped member was used.

First, a pair of support units are set so as to match the length of the polymer insulator 102 to be loaded on a pallet 101 as in Embodiment 1, and two support members 108 are installed in parallel to the support unit and at equal intervals between the shelf portions of the support units. Then, twelve polymer insulators 102 are mounted in parallel so that the holding metal fitting comes into contact with the upper end face of flat plate shaped member, that is, the shelf portion.

Next, the support units are connected and stacked by fitting the convex portion at the upper end of the support unit into the concave portion of another support unit, and polymer insulators are mounted in parallel likewise between the shelf portions of other support units.

After support unit groups 103 and 104 are formed by repeating the above operation eight times, cover materials 105 are put and fixed on the top end faces of the uppermost support units, by which the support unit groups are fastened in order not to be separated from each other. At both sides of the support unit groups, two braces are installed on diagonal lines so as to intersect, by which the pallet 101 and the support unit groups 103 and 104 are fastened in order not to be separated from each other.

(Embodiment 3)

Figure 12:
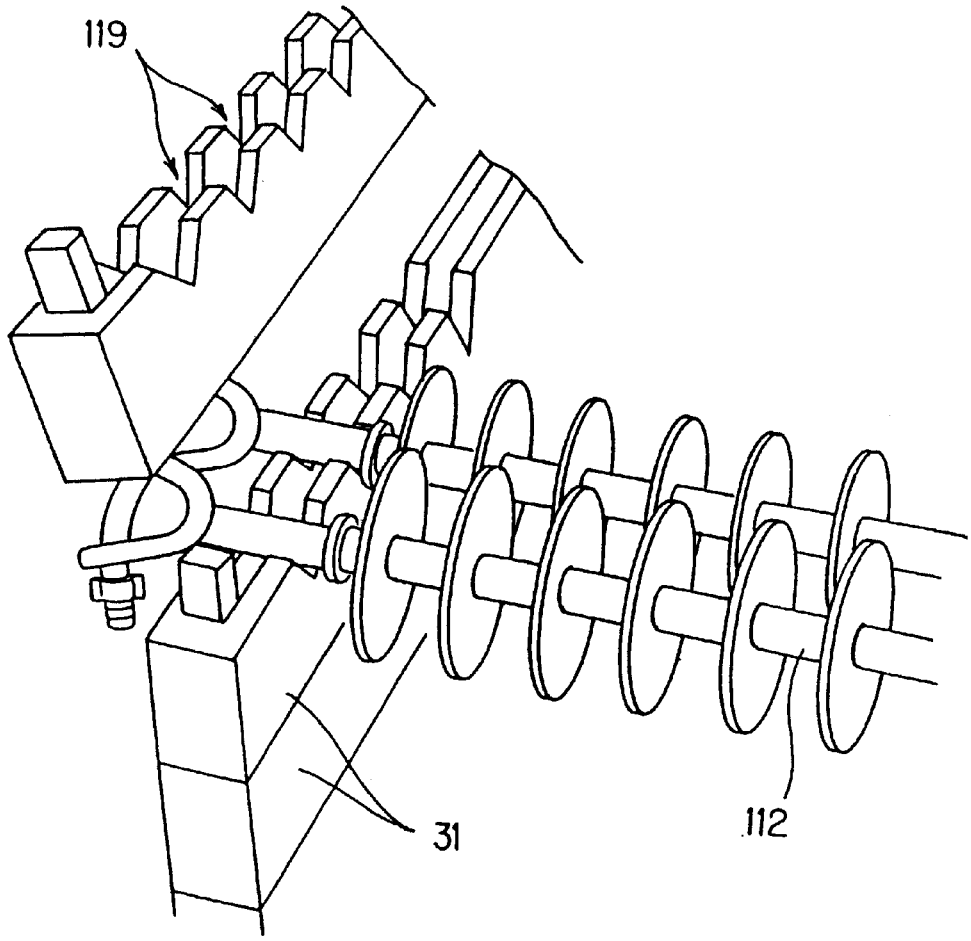
FIG. 12 is a schematic view showing still another Embodiment of a loading method for long objects in accordance with the present invention.

FIG. 12 shows an Embodiment in which notches 119 are formed in a support unit, which is the same as that in Embodiment 1, to prevent the rolling of a long object 112.

In this case, the rolling of the long object 112 on the shelf portion can be prevented, and also the length of the convex portion of connecting member can be made equal to or smaller than the depth of the concave portion because the long object can be inserted into the notch 119. Therefore, this configuration is preferable from the viewpoint of the fact that the strength of the fitting portion is secured, and the support units can be connected more surely.

As described above, in the support unit and assembled rack for loading long objects and the method of loading long objects using the same in accordance with the present invention, long objects can be stacked easily, products with a different length can be accommodated, lightweight can be achieved, a storage space is not needed, and the waste generated in disassembly can be reduced.

What is claimed is:

1. A support unit for supporting an end of a long object comprising:

a single, substantially planar, three-dimensional elongate plate member having substantially parallel planar side faces and substantially parallel first and second elongate edges, said first elongate edge including a shelf portion on which an end of a long object may be supported;

at least two pairs of three-dimensional connecting members of equal length, said pairs spaced along the length of the elongate plate member, the connecting members of each pair each having a substantially planar surface attached to one of the side faces of said elongate plate member, a first end of each connecting member being located along a side face and between the edges of the elongate plate member, and the other end of all connecting members overhanging the same edge of the elongate plate member, said first ends all being equidistant from an edge of the elongate plate member, and said other overhanging ends all being equidistant from said same edge thereof;

each pair of connecting members thereby forming an open-ended concave region of surfaces capable of accommodating an edge portion of another elongate plate member;

wherein the support unit is adapted to be stacked substantially vertically atop another support unit with the second edge of the elongate plate member of an upper support unit fitted into the concave regions formed by the pairs of connecting members of a lower support unit, with the planar faces of the connecting members of the lower support unit being parallel and contiguous to the side faces of the elongate plate member of the upper support unit.

2. The support unit of claim 1 wherein the planar faces of the connecting members of each pair are facing each other across the thickness of the elongate plate member.

3. The support unit of claim 1 wherein the first and second member ends of the connecting members are substantially planar and are substantially parallel to the edges of the elongate plate member.

4. The support unit of claim 1 wherein the planar end surfaces of the connecting members are substantially perpendicular to the planar side faces of the elongate plate member.

5. A rack including at least one first support unit for supporting an end of a long object in combination with at least one second like support unit, the support unit comprising:

a single, substantially planar, three-dimensional elongate plate member having substantially parallel planar side faces and substantially parallel first and second elongate edges, said first elongate edge including a shelf portion on which an end of a long object may be supported;

at least two pairs of three-dimensional connecting members of equal length, said pairs spaced along the length of the elongate plate member, the connecting members of each pair each having a substantially planar surface attached to one of the side faces of said elongate plate member, a first end of each connecting member being located along a side face and between the edges of the elongate plate member, and the other end of all connecting members overhanging the same edge of the elongate plate member, said first ends all being equidistant from an edge of the elongate plate member, and said other overhanging ends all being equidistant from said same edge thereof;

each pair of connecting members thereby forming an open-ended concave region of surfaces capable of accommodating an edge portion of another elongate plate member;

wherein the support unit is adapted to be stacked substantially vertically atop another support unit with the second edge of the elongate plate member of an upper support unit fitted into the concave regions formed by the pairs of connecting members of a lower support unit, with the planar surface of the connecting members of the lower support unit being parallel and contiguous to the side faces of the elongate plate member of the upper support unit.

6. The rack of claim 5, including a plurality of said support units arranged in a first stack in combination with at least one second like stack, wherein each stack is spaced apart from others of said stacks, and the elongate plate members of the support units of each stack is substantially parallel to the elongate plate members of the support units of other stacks.

7. The rack of claim 6, wherein a plurality of the stacked support units have at least one opening in the shelf portions thereof to prevent a long object from moving in a direction parallel to the length of the elongate plate members.

8. The rack of claim 6 additionally comprising a pallet supporting each of said plurality of stacks of support units.

9. The rack of claim 6 configured for supporting ends of a plurality of polymer insulators on the shelf portions of a plurality of the support units therein.

* * * * *